United States Patent [19]

Kyochika et al.

[11] Patent Number: 4,906,248

[45] Date of Patent: Mar. 6, 1990

[54] DYEING ASSISTANT COMPOSITION FOR CELLULOSE FIBERS

[75] Inventors: Naoki Kyochika; Shigeru Nagao, both of Wakayama, Japan

[73] Assignee: Kao Corporation, Tokyo, Japan

[21] Appl. No.: 177,875

[22] Filed: Mar. 24, 1988

Related U.S. Application Data

[63] Continuation of Ser. No. 857,916, Apr. 30, 1986, abandoned.

[30] Foreign Application Priority Data

May 17, 1985 [JP] Japan ..... 60-105674

[51] Int. Cl.[4] ..... C09B 67/00

[52] U.S. Cl. ..... 8/589; 8/527; 8/532; 8/587

[58] Field of Search ..... 8/558, 587, 532, 589, 8/527

[56] References Cited

U.S. PATENT DOCUMENTS 4,245,994 1/1981 Lipowski ..... 8/587

4,297,100 10/1981 Koci et al. ..... 8/558

*Primary Examiner*—Paul Lieberman

*Assistant Examiner*—John F. McNally

*Attorney, Agent, or Firm*—Flynn, Thiel, Boutell & Tanis

[57] ABSTRACT

Cellulose fibers can be effectively dyed with an assistant composition comprising (a) a polymer or copolymer of maleic acid, acrylic acid, methacylic acid or a salt thereof and (b) a sulfonate of a monocyclic or polycyclic aromatic compound or a condensate thereof with an aliphatic aldehyde.

3 Claims, No Drawings

DYEING ASSISTANT COMPOSITION FOR CELLULOSE FIBERS

This application is a continuation of U.S. Ser. No. 857,916, filed Apr. 30, 1986, now abandoned.

The present invention relates to a dyeing assistant used for dyeing cellulosic fibers. More particularly, the invention relates to a dyeing assistant used for dyeing cellulosic fibers and capable of dyeing them levelly.

STATEMENT OF PRIOR ARTS

Usually, cellulosic fibers are dyed with direct dye, sulfur dye, indanthrene dye, naphthol dye, reactive dye, basic dye or oxidation dye. Among them, the direct dye dyes the fibers according to their physicochemical adsorption and the color fastness is enhanced easily by a fixing treatment effected after the dyeing. Though the sulfur dye has an excellent color fastness, brightness of color is poor. The indanthrene dye exhibits quite a high color fastness. Though the naphthol dye exhibits a relatively clear color tone and high color fastness, it necessitates complicated steps of treatment of fibers with an impregnating agent and development by the diazotizing treatment with a developer. The reactive dye dyes the fibers by forming covalent bonds between the dye and the fibers to exhibit a vivid color tone and high color fastness. The basic dye necessitates a mordanting step and exhibits only a low color fastness. The oxidation dye necessitates a complicated dyeing procedure and a hue realized thereby is unstable. Thus, the dyestuffs have respective characters. Among these dyes, direct dyes, indanthrene dyes and reactive dyes are used mainly.

In dyeing blends of cellulosic fibers and synthetic or semi-synthetic fibers, a combination of two or more dyes is used. For example, in dyeing a polyester/cellulose fiber blend, a combination of a disperse dye/reactive dye, disperse dye/direct dye or disperse dye/indanthrene dye is used.

In practical dyeing, an alkali, inorganic salt and surfactant (dyeing assistant) are used, if necessary, so as to activate the dye, to improve the affinity of the dye with the fibers, to enhance the degree of exhaustion and to effect the level dyeing (see the specifications of Japanese Patent Publications Nos. 38711/1981 and 4742/1982).

The most important function required of the dyeing assistant is a level dyeing capacity. Particularly when a direct dye, reactive dye or indanthrene dye is used in the form of a leuco salt in dyeing cellulosic fibers, the use of a dyeing assistant which is effective in lowering the dyeing velocity (retarding effect) is desired, since such a dye is dispersed in the fibers and dyes them rapidly to cause deviation of the hue from an intended one or uneven dyeing. Further, in dyeing a fiber blend containing cellulosic fibers with two or more dyes, fibers other than those to be dyed are contaminated with the dye frequently (so-called facing) and, therefore, a dyeing assistant is necessitated for preventing this phenomenon.

To solve the above-mentioned problems, the following additives are used either alone or in the form of a mixture of them: polyoxyethylene alkyl ethers, polyoxyethylenealkylamines, polyoxyethylene alkyl ether sulfates, fatty acid ester sulfates, alkylnaphthalenesulfonates, alkylnaphthalenesulfonic acid/formalin condensates and surfactants such as betaine-type ampholytic surfactants. However, their effects are not necessarily sufficient and the problems have not been solved yet.

Hardening components (metal ions such as $Ca^{2+}$ and $Mg^{2+}$) in water used for dyeing the fibers are also one of the factors which affect the dyeing. More particularly, when water used in the dyeing has a high hardness, level dyeing is impossible, since these components inhibit solubilization and dispersion of the dye. Even when water of a low hardness is used, the darkness or deepness and hue of the products dyed with the same formulation will vary depending on the season, since the amount of the hardening components in water varies depending on the season.

To solve this problem, chelating agents such as ethylenediaminetetraacetic acid, diethylenetriaminepentaacetic acid, hydroxyethylenediaminetriacetic acid and nitrilotriacetic acid are used in some cases. Though these chelating agents are somewhat effective in capturing some of the hardening components in water thereby helping to realize level dyeing, this effect is only slight and rather these chelating agents have fatal problems such that when a metal-containing dye is used, the chelating agent forms a complex salt with the metal (color-developing group) in the dye and the balance of the coordination bond between the dye and the metal is broken and, consequently, the hue of the dyed cloth deviates from an intended hue. The indanthrene dye which is an important dye for dyeing cellulosic fibers is one having two or more carbonyl groups and is insoluble in water. In dyeing the cellulosic fibers with the indanthrene dye, this dye is reduced with an alkali to convert the carbonyl groups into sodium leuco salt form which is water-soluble and which has a high affinity with the cellulosic fibers, the fibers are dyed with this dye and then the sodium leuco salt is oxidized into a quinone with an acid to develop a color and also to make it water-insoluble. This dyeing process has the following problem which must await solution. Namely, when water having a high hardness is used in the dyeing, the hardening components contained in water are bonded with the dye to form a dye dimer which is insoluble in water and which has no affinity with the cellulosic fibers and, therefore, a darkness or deepness expected from the employed dye concentration cannot be obtained. Though a chelating agent such as ethylenediaminetetraacetic acid, diethylenetriaminepentaacetic acid, hydroxyethylenediaminetriacetic acid or nitrilotriacetic acid is used to solve this problem, the effects thereof are yet insufficient and the problem has not been solved drastically.

SUMMARY OF THE INVENTION

After intensive investigations made for the purpose of solving the above-mentioned problems in dyeing cellulosic fibers, the inventors have found that the problems can be solved by using a combination of two compounds as will be described below. The present invention has been completed on the basis of this finding.

The present invention provides a dyeing assistant for cellulosic fibers which comprises:

(a) a polymer or copolymer comprising one or more monomers selected from the group consisting of maleic, acrylic and methacrylic acids as constituting unit(s) or its salt, and (b) a sulfonated monocyclic or polycyclic aromatic compound or its condensate with an aliphatic aldehyde.

The invention composition is defined also to comprise (a) a polymer or copolymer of maleic acid, acrylic acid, methacylic acid or a salt thereof and (b) a sulfonate of a monocyclic or polycyclic aromatic compound or a condensate thereof with an aliphatic aldehyde.

The invention also provides a method for dyeing cellulose fibers with the use of the dyeing assistant composition as defined above.

The component (a) to use in the present invention has a number-average molecular weight of preferably 1000 to 8000.

The salts used as the component (a) include those of alkali metals, ammonium and alkanolamines such as diethanolamine and triethanolamine. They may contain a non-neutralized part so far as their capacity is not reduced.

The polymers or copolymers used as the component (a) may be ones copolymerized with a monomer other than maleic or (meth)acrylic acid so far as their capacity is not reduced. Examples of the monomers include acrylamide, sulfonic acids such as methacrylsulfonic and vinylsulfonic acids, 2-hydroxyethyl acrylate, acrylic esters, methacrylic esters, N-methylolacrylamide and other copolymerizable monomers.

Examples of the components (b) used in the present invention include aromatic hydrocarbons such as benzene, naphthalene, fluorene, anthracene, phenanthrene, pyrene, naphthacene, pentacene, coronene, hexene, heptacene, octacene, nonacene, decene, undecacene, dodecacene and acenaphthene; aromatic hydrocarbon mixtures such as creosote oil and cracking products of petroleum; and water-soluble salts such as alkali metal salts, ammonium salts, alkaline earth metal salts and alkanolamine salts of aliphatic aldehyde condensates of sulfonated aromatic compounds including derivatives of them having 1 or 2 alkyl groups having 1 to 5 carbon atoms. Examples of the aliphatic aldehydes include formalin, glyoxal and acetaldehyde. Among them, formalin is preferred.

Among the above-mentioned compounds, particularly preferred are formalin condensates of naphthalenesulfonic acid salts, ligninsulfonic acid salts and alkylnaphthalenesulfonic acid salts in which the alkyl group has 1 to 8 carbon atoms.

The dyeing assistant of the present invention used in dyeing cellulosic fibers comprises a combination of the above-mentioned components (a) and (b). The mixing ratio of the component (a) to the component (b) is preferably in the range of 10 to 90/90 to 10, particularly 40 to 60/60 to 40. The dyeing assistant of the present invention for cellulosic fibers may contain further anionic, cationic or nonionic surfactants so far as the effect thereof is not deteriorated. Examples of the surfactants which can be incorporated in the dyeing assistant of the present invention for cellulosic fibers include polyoxyethylene alkyl ethers, polyoxyethylenealkylamines, polyoxyethylene alkyl ether sulfates, fatty acid ester sulfates and betaine-type ampholytic surfactants.

Examples of the cellulosic fibers which can be dyed with a dye by using the dyeing assistant of the present invention include natural cellulosic fibers such as cotton and hemp fibers; and fiber blends of these natural cellulosic fibers with synthetic fibers such as nylon, polyester and acrylic fibers, with semi-synthetic fibers such as acetate fibers or with regenerated fibers such as rayon and cupra fibers. The form of the fibers to be dyed may be any of the fibers per se, threads, hanks, cheeses, woven fabrics, knittings, non-woven fabrics and final fibrous products such as clothes and beddings.

The amount of the dyeing assistant of the present invention which varies depending on the variety and concentration of the dye used is usually 0.01 to 20 g (in terms of the solid) and preferably 0.04 to 10 g per liter of the dyeing bath.

When the dyeing assistant of the present invention for cellulosic fibers is used in dyeing such fibers, a stable dyeing is made possible without being influenced by the hardness of the water used and changes in hue of a metal-containing dye can be prevented. Though the mechanism of effecting the level dyeing irrespective of the change in the hardness of water has not fully been elucidated, it may be supposed that a sequestering capacity of the component (a) contained in the dyeing assistant of the present invention for the cellulosic fibers is effective on only polyvalent metal ions contained in water used but not effective on polyvalent metals (color developing groups) in the dye. Further, supposedly, the formation of a water-insoluble dye polymer having a poor affinity with the fibers by the ion-crosslinking of the anionic group in the dye with the polyvalent metal ion is also prevented and, therefore, reduction of darkness or deepness of the dyed color is also prevented. It is conceivable, in addition, that the component (b) having a chemical structure similar to that of the dye and a high dye-solubilizing capacity competes with the dye for the location of adsorption in the fibers to lower the dyeing speed and therefore realizes the level dyeing.

Each component to use in the invention composition can be obtained by a conventional preparation process. For example, an acrylic polymer, one of the component (a), can be prepared by adding acrylic acid and ammonium persulfate dropwise to an aqueous solution of iso-propyl alcohol. Sodium salt of a copolymer of acrylic acid and maleic anhydride, another example of the component (a), can be obtained by conducting the aqueous solution polymerization of sodium neutralized products of acrylic acid and maleic anhydride in the presence of ammonium persulfate. Naphthalene sulfonate, one of the (b), components can be obtained by a reaction between naphthalene and concentrated sulfuric acid. Then a condensate thereof can be prepared by addition of formalin to the sulfonate and heating of the mixture.

The following examples will further illustrate the present invention, which by no means limit the invention.

(Composition Examples)

Dyeing assistants of the present invention for the cellulosic fibers having compositions shown in Table 1 were prepared.

TABLE 1

| Components | Composition Present invention | | | | | | | |
|---|---|---|---|---|---|---|---|---|
| | 1 | 2 | 3 | 4 | 5 | 6 | 7 | 8 |
| (1) Polysodium acrylate (molecular weight: about 5,000) | | 20 | | | | 60 | 10 | |
| Polyammonium acrylate (molecular weight: about 8,000) | 50 | | | | | | | |
| Polysodium maleate (molecular weight: about 1,000) | | | 40 | | | | | |
| Sodium salt of copolymer (1) (molecular weight: about 3,000) | | | | 60 | | | | 90 |

TABLE 1-continued

| Components | Composition Present invention | | | | | | | |
|---|---|---|---|---|---|---|---|---|
| | 1 | 2 | 3 | 4 | 5 | 6 | 7 | 8 |
| Sodium salt of copolymer (2) (molecular weight: about 6,000) | | | | | 30 | | | |
| (2) Sodium naphthalenesulfonate/formalin condensate (degree of condensation: 3) | 50 | | 60 | | 70 | 40 | | 10 |
| Ammonium naphthalenesulfonate/formalin condensate (degree of condensation: 6) | | 80 | | 40 | | | 90 | |

The molecular weights are shown in terms of the number-average molecular weights determined by VPO (vapor pressure osmometry).
Copolymer (1): maleic acid/acrylic acid = 1.0/1.0 (molar ratio)
Copolymer (2): maleic acid/acrylic acid = 0.1/1.0 (molar ratio)

EXAMPLE 1

A cotton twill was dyed and its hue and level dyeability and the dye dispersibility in the dyeing bath were examined. The results are shown in Table 2.

<Dyeing conditions>

| | |
|---|---|
| hardness of water used | 0 and 20° DH |
| dye | Kayarus Spra Blue 4BL conc. 1% owf (a metal-containing direct dye of Nippon Kayaku Co., Ltd.) |
| Glauber's salt | 10% owf |
| dyeing assistant | see Table 2 |
| bath ratio | 1/30 |
| dyeing temperature | 90° C. |
| dyeing time | 30 min |

-continued

| | |
|---|---|
| remarks | The twill was soaped by an ordinary process after dyeing. |

<Evaluation>

The color of the dyed twill was examined with an SM color computer SM-3 (a product of Suga Shikenki K.K.) to determine its hue value (a value on the Munsell hue ring) as a measure of the hue. Partial unevenness of color deepness was examined visually and employed as a measure of the level dyeing. 300 g of a mixture (dyeing solution) of water, dye (0.1%) and the dyeing assistant (0.1%) was prepared. After being left to stand for 24 h, the mixture was filtered through a 5A filter paper (a product of Toyo Filter Paper Co., Ltd.) and the residue remaining on the filter paper was examined visually and employed as a measure of the dye dispersibility.

TABLE 2

| | | Hardness of water | | | | | | | | | | | | | |
|---|---|---|---|---|---|---|---|---|---|---|---|---|---|---|---|
| | | 0° DH | | | | | | | | | | | | | |
| | | Test No. | | | | | | | | | | | | | |
| Dyeing assistant | | 1 | 2 | 3 | 4 | 5 | 6 | 7 | 8 | 9 | 10 | 11 | 12 | 13 | 14 |
| Comparative | EO (13 mol) adduct of oleyl alcohol (g/l) | 0 | 1 | 0 | 0 | 0 | 0 | 0 | 0 | 0 | 0 | 0 | 0 | 0 | 0 |
| | Sodium EO (13 mol)/oleyl alcohol adduct sulfate (g/l) | 0 | 0 | 1 | 0 | 0 | 0 | 0 | 0 | 0 | 0 | 0 | 0 | 0 | 0 |
| Polysodium acrylate (molecular weight: 5,000) (g/l) | | 0 | 0 | 0 | 1 | 0 | 0 | 0 | 0 | 0 | 0 | 0 | 0 | 0 | 0 |
| Naphthalenesulfonic acid/formalin condensate (degree of condensation: 3) (g/l) | | 0 | 0 | 0 | 0 | 1 | 0 | 0 | 0 | 0 | 0 | 0 | 0 | 0 | 0 |
| Ethylenediaminetetraacetic acid (g/l) | | 0 | 0 | 0 | 0 | 1 | 0 | 0 | 0 | 0 | 0 | 0 | 0 | 0 | 0 |
| Present invention | Composition 1 (g/l) | 0 | 0 | 0 | 0 | 0 | 0 | 0 | 0 | 0 | 0 | 0 | 0 | 0 | 0 |
| | Composition 2 (g/l) | 0 | 0 | 0 | 0 | 0 | 0 | 0 | 1 | 0 | 0 | 0 | 0 | 0 | 0 |
| | Composition 3 (g/l) | 0 | 0 | 0 | 0 | 0 | 0 | 0 | 0 | 1 | 0 | 0 | 0 | 0 | 0 |
| | Composition 4 (g/l) | 0 | 0 | 0 | 0 | 0 | 0 | 0 | 0 | 0 | 1 | 0 | 0 | 0 | 0 |
| | Composition 5 (g/l) | 0 | 0 | 0 | 0 | 0 | 0 | 0 | 0 | 0 | 0 | 1 | 0 | 0 | 0 |
| | Composition 6 (g/l) | 0 | 0 | 0 | 0 | 0 | 0 | 0 | 0 | 0 | 0 | 0 | 1 | 0 | 0 |
| | Composition 7 (g/l) | 0 | 0 | 0 | 0 | 0 | 0 | 0 | 0 | 0 | 0 | 0 | 0 | 1 | 0 |
| | Composition 8 (g/l) | 0 | 0 | 0 | 0 | 0 | 0 | 0 | 0 | 0 | 0 | 0 | 0 | 0 | 1 |
| Hue value | | 2.51 PB | 2.50 PB | 2.52 PB | 2.51 PB | 2.51 PB | 7.53 PB | 2.50 PB | 2.52 PB | 2.50 PB | 2.48 PB | 2.51 PB | 2.53 PB | 2.49 PB | 2.50 PB |
| Partial unevenness of darkness* | | o ~ Δ | o | o | o~Δ | o | o~Δ | o | o | o | o | o | o | o | o |
| Filtration residue | | none | none | none | none | none | none | none | none | none | none | none | none | none | none |

| | | Hardness of water | | | | | | | | | | | | | |
|---|---|---|---|---|---|---|---|---|---|---|---|---|---|---|---|
| | | 20° DH | | | | | | | | | | | | | |
| | | Test No. | | | | | | | | | | | | | |
| Dyeing assistant | | 15 | 16 | 17 | 18 | 19 | 20 | 21 | 22 | 23 | 24 | 25 | 26 | 27 | 28 |
| Comparative | EO (13 mol) adduct of oleyl alcohol (g/l) | 0 | 1 | 0 | 0 | 0 | 0 | 0 | 0 | 0 | 0 | 0 | 0 | 0 | 0 |
| | Sodium EO (13 mol)/oleyl alcohol adduct sulfate (g/l) | 0 | 0 | 1 | 0 | 0 | 0 | 0 | 0 | 0 | 0 | 0 | 0 | 0 | 0 |
| Polysodium acrylate (molecular weight: 5,000) (g/l) | | 0 | 0 | 0 | 1 | 0 | 0 | 0 | 0 | 0 | 0 | 0 | 0 | 0 | 0 |
| Naphthalenesulfonic acid/formalin condensate (degree of condensation: 3) (g/l) | | 0 | 0 | 0 | 0 | 1 | 0 | 0 | 0 | 0 | 0 | 0 | 0 | 0 | 0 |
| Ethylenediaminetetraacetic acid (g/l) | | 0 | 0 | 0 | 0 | 0 | 1 | 0 | 0 | 0 | 0 | 0 | 0 | 0 | 0 |
| Present invention | Composition 1 (g/l) | 0 | 0 | 0 | 0 | 0 | 0 | 1 | 0 | 0 | 0 | 0 | 0 | 0 | 0 |
| | Composition 2 (g/l) | 0 | 0 | 0 | 0 | 0 | 0 | 0 | 1 | 0 | 0 | 0 | 0 | 0 | 0 |
| | Composition 3 (g/l) | 0 | 0 | 0 | 0 | 0 | 0 | 0 | 0 | 1 | 0 | 0 | 0 | 0 | 0 |
| | Composition 4 (g/l) | 0 | 0 | 0 | 0 | 0 | 0 | 0 | 0 | 0 | 1 | 0 | 0 | 0 | 0 |
| | Composition 5 (g/l) | 0 | 0 | 0 | 0 | 0 | 0 | 0 | 0 | 0 | 0 | 1 | 0 | 0 | 0 |
| | Composition 6 (g/l) | 0 | 0 | 0 | 0 | 0 | 0 | 0 | 0 | 0 | 0 | 0 | 1 | 0 | 0 |
| | Composition 7 (g/l) | 0 | 0 | 0 | 0 | 0 | 0 | 0 | 0 | 0 | 0 | 0 | 0 | 1 | 0 |
| | Composition 8 (g/l) | 0 | 0 | 0 | 0 | 0 | 0 | 0 | 0 | 0 | 0 | 0 | 0 | 0 | 1 |
| Hue value | | 2.58 PB | 2.55 PB | 2.56 PB | 2.55 PB | 2.57 PB | 3.85 PB | 2.50 PB | 2.52 PB | 2.50 PB | 2.48 PB | 2.51 PB | 2.53 PB | 2.49 PB | 2.50 PB |

TABLE 2-continued

| | | | | | | | | | | | | | | |
|---|---|---|---|---|---|---|---|---|---|---|---|---|---|---|
| Partial unevenness of darkness* | x | x | x | o~Δ | x | Δ | o | o | o | o | o | o | o | o |
| Filtration residue | | | | none | none | none | none | none | none | none | none | none | none | none |

(Note)
PB in the column of hue value in the above table refers to a hue of blue/purple. The lower the value of PB, the closer to B (blue) and the higher the value of PB, the closer to P (purple).
*o: none at all, Δ: a small amount, x: considerable.

It is apparent from the results shown in Table 2 that when the dyeing assistant of the present invention for the cellulosic fibers is used, dyeing similar to that obtained by using water of a low hardness can be obtained even if water having a high hardness is used and no problem is posed with respect to the hue value, level dyeing or dye dispersibility. On the contrary, when ethylenediaminetetraacetic acid is used, a significant color change is observed even when water having a hardness of 0° DH is used and when the comparative dye assistant is used, problems are posed with respect to the level dyeing and dye dispersibility in case water having a high hardness is used.

EXAMPLE 2

Cotton knittings were dyed and their hue and level dyeability and dye dispersibility in the dyeing solution were examined. The results are shown in Table 3.

<Dyeing conditions>

| | |
|---|---|
| hardness of water used | 0 and 20° DH |
| dye | Sumifix Red 3B, 1% owf (a metal-containing reactive dye of Sumitomo Chemical Co., Ltd.) |
| Glauber's salt | 30 g/l |
| soda ash | 15 g/l |
| dyeing assistant | see Table 3 |
| bath ratio: | 1/30 |
| dyeing temperature | 60° C. |
| dyeing time | 30 min |
| remarks | The cotton knittings were soaped by an ordinary process after dyeing. |

<Evaluation>

The color of the dyed knittings was examined with an SM color computer SM-3 of Suga Shikenki K.K. to determine its hue value (a value on the Munsell hue ring) as a measure of the hue. Partial unevenness of color deepness was examined visually and employed as a measure of the level dyeing. 300 g of a mixture (dyeing solution) of water, dye (0.1%) and the dyeing assistant (0.1%) was prepared. After being left to stand for 24 h, the mixture was filtered through a 5A filter paper of Toyo Filter Paper Co., Ltd. and the residue remaining on the filter paper was examined visually and employed as a measure of the dye dispersibility.

TABLE 3

| | | Hardness of water | | | | | | | | | | | | | |
|---|---|---|---|---|---|---|---|---|---|---|---|---|---|---|---|
| | | 0° DH | | | | | | | | | | | | | |
| | | Test No. | | | | | | | | | | | | | |
| Dyeing assistant | | 29 | 30 | 31 | 32 | 33 | 34 | 35 | 36 | 37 | 38 | 39 | 40 | 41 | 42 |
| Comparative | EO (13 mol) adduct of oleyl alcohol (g/l) | 0 | 2 | 0 | 0 | 0 | 0 | 0 | 0 | 0 | 0 | 0 | 0 | 0 | 0 |
| | Sodium EO (13 mol)/oleyl alcohol adduct sulfate (g/l) | 0 | 0 | 2 | 0 | 0 | 0 | 0 | 0 | 0 | 0 | 0 | 0 | 0 | 0 |
| Polysodium acrylate (molecular weight: 5,000) (g/l) | | 0 | 0 | 0 | 2 | 0 | 0 | 0 | 0 | 0 | 0 | 0 | 0 | 0 | 0 |
| Naphthalenesulfonic acid/formalin condensate (degree of condensation: 3) (g/l) | | 0 | 0 | 0 | 0 | 2 | 0 | 0 | 0 | 0 | 0 | 0 | 0 | 0 | 0 |
| Diethylenetriamepentaacetic acid (g/l) | | 0 | 0 | 0 | 0 | 0 | 2 | 0 | 0 | 0 | 0 | 0 | 0 | 0 | 0 |
| Present invention | Composition 1 (g/l) | 0 | 0 | 0 | 0 | 0 | 0 | 2 | 0 | 0 | 0 | 0 | 0 | 0 | 0 |
| | Composition 2 (g/l) | 0 | 0 | 0 | 0 | 0 | 0 | 0 | 2 | 0 | 0 | 0 | 0 | 0 | 0 |
| | Composition 3 (g/l) | 0 | 0 | 0 | 0 | 0 | 0 | 0 | 0 | 2 | 0 | 0 | 0 | 0 | 0 |
| | Composition 4 (g/l) | 0 | 0 | 0 | 0 | 0 | 0 | 0 | 0 | 0 | 2 | 0 | 0 | 0 | 0 |
| | Composition 5 (g/l) | 0 | 0 | 0 | 0 | 0 | 0 | 0 | 0 | 0 | 0 | 2 | 0 | 0 | 0 |
| | Composition 6 (g/l) | 0 | 0 | 0 | 0 | 0 | 0 | 0 | 0 | 0 | 0 | 0 | 2 | 0 | 0 |
| | Composition 7 (g/l) | 0 | 0 | 0 | 0 | 0 | 0 | 0 | 0 | 0 | 0 | 0 | 0 | 2 | 0 |
| | Composition 8 (g/l) | 0 | 0 | 0 | 0 | 0 | 0 | 0 | 0 | 0 | 0 | 0 | 0 | 0 | 2 |
| Hue value | | 5.41 RP | 5.38 RP | 5.40 RP | 5.39 RP | 5.42 RP | 2.01 RP | 5.40 RP | 5.42 RP | 5.39 RP | 5.42 RP | 5.40 RP | 5.41 RP | 5.43 RP | 5.40 RP |
| Partial unevenness of darkness* | | o~ Δ | o | o | o~Δ | o | o~Δ | o | o | o | o | o | o | o | |
| Filtration residue | | none | none | none | none | none | none | none | none | none | none | none | none | none | none |

| | | Hardness of water | | | | | | | | | | | | | |
|---|---|---|---|---|---|---|---|---|---|---|---|---|---|---|---|
| | | 20° DH | | | | | | | | | | | | | |
| | | Test No. | | | | | | | | | | | | | |
| Dyeing assistant | | 43 | 44 | 45 | 46 | 47 | 48 | 49 | 50 | 51 | 52 | 53 | 54 | 55 | 56 |
| Comparative | EO (13 mol) adduct of oleyl alcohol (g/l) | 0 | 2 | 0 | 0 | 0 | 0 | 0 | 0 | 0 | 0 | 0 | 0 | 0 | 0 |
| | Sodium EO (13 mol)/oleyl alcohol adduct sulfate (g/l) | 0 | 0 | 2 | 0 | 0 | 0 | 0 | 0 | 0 | 0 | 0 | 0 | 0 | 0 |
| Polysodium acrylate (molecular weight: 5,000) (g/l) | | 0 | 0 | 0 | 2 | 0 | 0 | 0 | 0 | 0 | 0 | 0 | 0 | 0 | 0 |
| Naphthalenesulfonic acid/formalin condensate (degree of condensation: 3) (g/l) | | 0 | 0 | 0 | 0 | 2 | 0 | 0 | 0 | 0 | 0 | 0 | 0 | 0 | 0 |
| Diethylenetriaminepentaacetic acid (g/l) | | 0 | 0 | 0 | 0 | 0 | 2 | 0 | 0 | 0 | 0 | 0 | 0 | 0 | 0 |
| Present invention | Composition 1 (g/l) | 0 | 0 | 0 | 0 | 0 | 0 | 2 | 0 | 0 | 0 | 0 | 0 | 0 | 0 |
| | Composition 2 (g/l) | 0 | 0 | 0 | 0 | 0 | 0 | 0 | 2 | 0 | 0 | 0 | 0 | 0 | 0 |
| | Composition 3 (g/l) | 0 | 0 | 0 | 0 | 0 | 0 | 0 | 0 | 2 | 0 | 0 | 0 | 0 | 0 |
| | Composition 4 (g/l) | 0 | 0 | 0 | 0 | 0 | 0 | 0 | 0 | 0 | 2 | 0 | 0 | 0 | 0 |
| | Composition 5 (g/l) | 0 | 0 | 0 | 0 | 0 | 0 | 0 | 0 | 0 | 0 | 2 | 0 | 0 | 0 |
| | Composition 6 (g/l) | 0 | 0 | 0 | 0 | 0 | 0 | 0 | 0 | 0 | 0 | 0 | 2 | 0 | 0 |
| | Composition 7 (g/l) | 0 | 0 | 0 | 0 | 0 | 0 | 0 | 0 | 0 | 0 | 0 | 0 | 2 | 0 |

TABLE 3-continued

| Composition 8 (g/l) | 0 | 0 | 0 | 0 | 0 | 0 | 0 | 0 | 0 | 0 | 0 | 0 | 0 | 2 |
|---|---|---|---|---|---|---|---|---|---|---|---|---|---|---|
| Hue value | 5.38 RP | 5.37 RP | 5.38 RP | 5.40 RP | 5.36 RP | 4.75 RP | 5.40 RP | 5.39 RP | 5.42 RP | 5.41 RP | 5.39 RP | 5.40 RP | 5.42 RP | 5.41 RP |
| Partial unevenness of darkness* | x | x | x | o~Δ | x | Δ | o | o | o | o | o | o | o | o |
| Filtration residue | | | | none | | | none | none | none | none | none | none | none | none |

(Note)
RP in the column of hue value in the above table refers to a hue of red/purple. The lower the value of RP, the closer to P (purple) and the higher the value of RP, the closer to R (red).
*o: none at all, Δ: a small amount, x: considerable.

It is apparent from the results shown in Table 3 that when the dyeing assistant of the present invention for the cellulosic fibers is used, dyeing similar to that obtained by using water of a low hardness can be obtained even if water having a high hardness is used and no problem is posed with respect to the hue value, level dyeing or dye dispersibility. On the contrary, when diethylenetriaminepentaacetic acid is used, a significant color change is observed even if water having a hardness of 0° DH is used and when the comparative dye assistant is used, problems are posed with respect to the level dyeing and dye dispersibility in case water having a high hardness is used.

EXAMPLE 3

A cotton twill was dyed and its color darkness was examined to obtain the results shown in Table 4.

<Dyeing conditions>

| | |
|---|---|
| Hardness of water used | 0, 25 and 50° DH |
| dye | Mikethren Blue RSN s/f, 1% owf (an indanthrene dye of indanthrene dye of Mitsui Toatsu Chemicals, Inc.) |
| sodium hydrosulfite | 4 g/l |
| sodium hydroxide | 5 g/l |
| dyeing assistant | see Table 4 |
| dyeing temperature | 60° C. |
| dyeing time | 20 min |
| remarks | The cotton twill was soaped by an ordinary process after dyeing. |

<Evaluation>

The color of the dyed cloth was examined with an SM color computer SM-3 of Suga Shikenki K.K. to determine its C*-value as a measure of the color deepness. Partial unevenness of deepness was examined visually and employed as a measure of the level dyeing.

TABLE 4

| | | Hardness of water | | | | | | | | | | | | | |
|---|---|---|---|---|---|---|---|---|---|---|---|---|---|---|---|
| | | 0° DH | | | | | | | | | | | | | |
| | | Test No. | | | | | | | | | | | | | |
| Dyeing assistant | | 57 | 58 | 59 | 60 | 61 | 62 | 63 | 64 | 65 | 66 | 67 | 68 | 69 | 70 |
| EO (13 mol) adduct of oleyl alcohol (g/l) | | 0 | 2 | 0 | 0 | 0 | 0 | 0 | 0 | 0 | 0 | 0 | 0 | 0 | 0 |
| Sodium EO (13 mol)/oleyl alcohol adduct sulfate (g/l) | | 0 | 0 | 2 | 0 | 0 | 0 | 0 | 0 | 0 | 0 | 0 | 0 | 0 | 0 |
| Sodium salt of copolymer (1) (molecular weight: about 3,000) (g/l) | | 0 | 0 | 0 | 2 | 0 | 0 | 0 | 0 | 0 | 0 | 0 | 0 | 0 | 0 |
| Ammonium naphthalene sulfonate/ formalin condensate (degree of condensation: 6) (g/l) | | 0 | 0 | 0 | 0 | 2 | 0 | 0 | 0 | 0 | 0 | 0 | 0 | 0 | |
| Ethylenediaminetetraacetic acid (g/l) | | 0 | 0 | 0 | 0 | 0 | 2 | 0 | 0 | 0 | 0 | 0 | 0 | 0 | 0 |
| Present invention | Composition 1 (g/l) | 0 | 0 | 0 | 0 | 0 | 0 | 2 | 0 | 0 | 0 | 0 | 0 | 0 | 0 |
| | Composition 2 (g/l) | 0 | 0 | 0 | 0 | 0 | 0 | 0 | 2 | 0 | 0 | 0 | 0 | 0 | 0 |
| | Composition 3 (g/l) | 0 | 0 | 0 | 0 | 0 | 0 | 0 | 0 | 2 | 0 | 0 | 0 | 0 | 0 |
| | Composition 4 (g/l) | 0 | 0 | 0 | 0 | 0 | 0 | 0 | 0 | 0 | 2 | 0 | 0 | 0 | 0 |
| | Composition 5 (g/l) | 0 | 0 | 0 | 0 | 0 | 0 | 0 | 0 | 0 | 0 | 2 | 0 | 0 | 0 |
| | Composition 6 (g/l) | 0 | 0 | 0 | 0 | 0 | 0 | 0 | 0 | 0 | 0 | 0 | 2 | 0 | 0 |
| | Composition 7 (g/l) | 0 | 0 | 0 | 0 | 0 | 0 | 0 | 0 | 0 | 0 | 0 | 0 | 2 | 0 |
| | Composition 8 (g/l) | 0 | 0 | 0 | 0 | 0 | 0 | 0 | 0 | 0 | 0 | 0 | 0 | 0 | 2 |
| C* value | | 10.55 | 10.52 | 10.55 | 10.56 | 10.54 | 10.55 | 10.54 | 10.56 | 10.56 | 10.55 | 10.57 | 10.53 | 10.55 | 10.56 |
| Partial unevenness of darkness* | | o~Δ | o | o | o~Δ | o | o~Δ | o | o | o | o | o | o | o | o |

| | | Hardness of water | | | | | | | | | | | | | |
|---|---|---|---|---|---|---|---|---|---|---|---|---|---|---|---|
| | | 25° DH | | | | | | | | | | | | | |
| | | Test No. | | | | | | | | | | | | | |
| Dyeing assistant | | 71 | 72 | 73 | 74 | 75 | 76 | 77 | 78 | 79 | 80 | 81 | 82 | 83 | 84 |
| EO (13 mol) adduct of oleyl alcohol (g/l) | | 0 | 2 | 0 | 0 | 0 | 0 | 0 | 0 | 0 | 0 | 0 | 0 | 0 | 0 |
| Sodium EO (13 mol)/oleyl alcohol adduct sulfate (g/l) | | 0 | 0 | 2 | 0 | 0 | 0 | 0 | 0 | 0 | 0 | 0 | 0 | 0 | 0 |
| Sodium salt of copolymer (1) (molecular weight: about 3,000) (g/l) | | 0 | 0 | 0 | 2 | 0 | 0 | 0 | 0 | 0 | 0 | 0 | 0 | 0 | 0 |
| Ammonium naphthalene sulfonate/ formalin condensate (degree of condensation: 6) (g/l) | | 0 | 0 | 0 | 0 | 2 | 0 | 0 | 0 | 0 | 0 | 0 | 0 | 0 | |
| Ethylenediaminetetraacetic acid (g/l) | | 0 | 0 | 0 | 0 | 0 | 2 | 0 | 0 | 0 | 0 | 0 | 0 | 0 | 0 |
| Present invention | Composition 1 (g/l) | 0 | 0 | 0 | 0 | 0 | 0 | 2 | 0 | 0 | 0 | 0 | 0 | 0 | 0 |
| | Composition 2 (g/l) | 0 | 0 | 0 | 0 | 0 | 0 | 0 | 2 | 0 | 0 | 0 | 0 | 0 | 0 |
| | Composition 3 (g/l) | 0 | 0 | 0 | 0 | 0 | 0 | 0 | 0 | 2 | 0 | 0 | 0 | 0 | 0 |
| | Composition 4 (g/l) | 0 | 0 | 0 | 0 | 0 | 0 | 0 | 0 | 0 | 2 | 0 | 0 | 0 | 0 |
| | Composition 5 (g/l) | 0 | 0 | 0 | 0 | 0 | 0 | 0 | 0 | 0 | 0 | 2 | 0 | 0 | 0 |
| | Composition 6 (g/l) | 0 | 0 | 0 | 0 | 0 | 0 | 0 | 0 | 0 | 0 | 0 | 2 | 0 | 0 |
| | Composition 7 (g/l) | 0 | 0 | 0 | 0 | 0 | 0 | 0 | 0 | 0 | 0 | 0 | 0 | 2 | 0 |
| | Composition 8 (g/l) | 0 | 0 | 0 | 0 | 0 | 0 | 0 | 0 | 0 | 0 | 0 | 0 | 0 | 2 |
| C* value | | 9.68 | 9.73 | 9.70 | 10.60 | 9.72 | 9.97 | 10.56 | 10.58 | 10.53 | 10.54 | 10.54 | 10.57 | 10.58 | 10.55 |
| Partial unevenness of darkness* | | x | x | x | o~Δ | x | Δ | o | o | o | o | o | o | | |

Hardness of water

TABLE 4-continued

| Dyeing assistant | | 50° DH Test No. 85 | 86 | 87 | 88 | 89 | 90 | 91 | 92 | 93 | 94 | 95 | 96 | 97 | 98 |
|---|---|---|---|---|---|---|---|---|---|---|---|---|---|---|---|
| EO (13 mol) adduct of oleyl alcohol (g/l) | | 0 | 2 | 0 | 0 | 0 | 0 | 0 | 0 | 0 | 0 | 0 | 0 | 0 | 0 |
| Sodium EO (13 mol)/oleyl alcohol adduct sulfate (g/l) | | 0 | 0 | 2 | 0 | 0 | 0 | 0 | 0 | 0 | 0 | 0 | 0 | 0 | 0 |
| Sodium salt of copolymer (1) (molecular weight: about 3,000) (g/l) | | 0 | 0 | 0 | 2 | 0 | 0 | 0 | 0 | 0 | 0 | 0 | 0 | 0 | 0 |
| Ammonium naphthalene sulfonate/formalin condensate (degree of condensation: 6) (g/l) | | 0 | 0 | 0 | 0 | 2 | 0 | 0 | 0 | 0 | 0 | 0 | 0 | 0 | |
| Ethylenediaminetetraacetic acid (g/l) | | 0 | 0 | 0 | 0 | 0 | 2 | 0 | 0 | 0 | 0 | 0 | 0 | 0 | 0 |
| Present invention | Composition 1 (g/l) | 0 | 0 | 0 | 0 | 0 | 0 | 2 | 0 | 0 | 0 | 0 | 0 | 0 | 0 |
| | Composition 2 (g/l) | 0 | 0 | 0 | 0 | 0 | 0 | 0 | 2 | 0 | 0 | 0 | 0 | 0 | 0 |
| | Composition 3 (g/l) | 0 | 0 | 0 | 0 | 0 | 0 | 0 | 0 | 2 | 0 | 0 | 0 | 0 | 0 |
| | Composition 4 (g/l) | 0 | 0 | 0 | 0 | 0 | 0 | 0 | 0 | 0 | 2 | 0 | 0 | 0 | 0 |
| | Composition 5 (g/l) | 0 | 0 | 0 | 0 | 0 | 0 | 0 | 0 | 0 | 0 | 2 | 0 | 0 | 0 |
| | Composition 6 (g/l) | 0 | 0 | 0 | 0 | 0 | 0 | 0 | 0 | 0 | 0 | 0 | 2 | 0 | 0 |
| | Composition 7 (g/l) | 0 | 0 | 0 | 0 | 0 | 0 | 0 | 0 | 0 | 0 | 0 | 0 | 2 | 0 |
| | Composition 8 (g/l) | 0 | 0 | 0 | 0 | 0 | 0 | 0 | 0 | 0 | 0 | 0 | 0 | 0 | 2 |
| C* value | | 8.83 | 8.87 | 8.91 | 10.53 | 8.88 | 9.24 | 10.57 | 10.53 | 10.55 | 10.56 | 10.56 | 10.56 | 10.52 | 10.55 |
| Partial unevenness of darkness* | | x | x | x | o~Δ | x | Δo | o | o | o | o | o | o | o | |

(Note)

C* is calculated according to the following formula:

$C^* = 21.72 \times 10^{C \cdot \tan H^\circ / 2V/2}$ in which C refers to chroma in the Munsell color system, V refers to value in the Munsell color system and, tan H° is $0.01 + 0.001\Delta H_{5p}$, $H_{5p}$ being a number of steps from a hue of 5.0 P in the Munsell hue ring divided into 100 steps. The lower the value of C*, the paler the color and the lower the deepness. The higher the value of C*, the higher the deepness of the color.

*o: none at all, Δ: a small amount, x: considerable.

It is apparent from the results shown in Table 4 that when the dyeing assistant of the present invention for cellulosic fibers is not used, the C* value is lowered and the level dyeing becomes difficult as the hardness of water is increased. This tendency is observed also when an ordinary dyeing assistant is used. On the contrary, when the dyeing assistant of the present invention is used, the color deepness (C* value) and level dyeing are not influenced by changes in the hardness of water.

[Effects of the Invention]

As shown in the above examples, when the dyeing assistant of the present invention for cellulosic fibers is used, dyeing similar to that obtained by using water of a low hardness can be obtained even if water having a high hardness is used. Therefore, dyeing having a given, uniform hue and dyeability can be obtained irrespective of changes in hardness of industrial water depending on the season.

Another effect of the dyeing assistant of the present invention for cellulosic fibers is that it foams only very slightly during the use and, therefore, it increases the working efficiency in the step of soaping effected after the dyeing.

The embodiments of the invention in which an exclusive property or privilege is claimed are defined as follows:

1. An aqueous dyeing bath consisting essentially of a dye for dyeing cellulose fibers, at least one alkali inorganic salt, from 0.04 to 10 g per liter of a dyeing assistant composition consisting essentially of (a) a polymer or copolymer of maleic acid, acrylic acid, or a salt thereof selected from the group consisting of polysodium acrylate, polyammonium acrylate, polysodium maleate and sodium salt of maleic acid/acrylic acid copolymer, and (b) a sulfonate of a polycyclic aromatic compound condensate with an aliphatic aldehyde selected from the group consisting of sodium naphthalenesulfonate/formalin condensate and ammonium naphthalenesulfonate/formalin condensate, wherein the weight ratio of (a)/(b) ranges from 90/10 to 10/90 and said polymer or copolymer has a number-average molecular weight of 1,000 to 8,000, and water.

2. In a method for dyeing cellulosic fibers in an aqueous dyeing bath, the improvement comprising said aqueous dyeing bath consisting essentially of a dye for dyeing said cellulosic fibers, at least one alkali inorganic salt, from 0.04 to 10 g per liter of a dyeing assistant composition consisting essentially of (a) a polymer or copolymer of maleic acid, acrylic acid, or a salt thereof selected from the group consisting of polysodium acrylate, polyammonium acrylate, polysodium maleate and sodium salt of maleic acid/acrylic acid copolymer and (b) a sulfonate of a polycyclic aromatic compound condensate with an aliphatic aldehyde selected from the group consisting of sodium naphthalenesulfonate/formalin condensate and ammonium naphthalenesulfonate/formalin condensate, wherein the weight ratio of (a)/(b) ranges from 90/10 to 10/90 and said polymer or copolymer has a number-average molecular weight of 1,000 to 8,000, and water.

3. The method of claim 2, wherein the cellulose fibers are one or more members selected from the group consisting of cotton fibers, hemp fibers and blends of cotton fibers and hemp fibers with nylon fibers, polyester fibers, acrylic fibers, acetate fibers, rayon fibers and cupra fibers.

* * * * *